United States Patent [19]

Tadokoro et al.

[11] Patent Number: 4,502,435

[45] Date of Patent: Mar. 5, 1985

[54] INTAKE SYSTEM FOR MULTIPLE CYLINDER INTERNAL COMBUSTION ENGINE

[75] Inventors: Tomoo Tadokoro; Toshimichi Akagi, both of Hiroshima, Japan

[73] Assignee: Mazda Motor Corporation, Hiroshima, Japan

[21] Appl. No.: 529,669

[22] Filed: Sep. 6, 1983

Related U.S. Application Data

[63] Continuation of Ser. No. 289,696, Aug. 3, 1981, abandoned, which is a continuation of Ser. No. 22,310, Mar. 20, 1979, abandoned.

[30] Foreign Application Priority Data

Mar. 24, 1978 [JP] Japan ..... 53-34653

[51] Int. Cl.[3] ..... F02D 17/02

[52] U.S. Cl. ..... 123/198 F; 123/52 MB; 123/59 PC; 261/23 A

[58] Field of Search ..... 123/52 M, 52 MB, 59 PC, 123/198 DB, 198 F, 308, 339, 432, 442; 261/23 A, 41 D

[56] References Cited

U.S. PATENT DOCUMENTS

| | | | |
|---|---|---|---|
| 1,307,896 | 6/1919 | Colardeau | 123/52 MB |
| 2,114,655 | 4/1938 | Leibing | 123/198 F |
| 3,578,116 | 5/1971 | Nakajima | 123/198 F |
| 3,698,371 | 10/1972 | Mitsuyama et al. | 123/198 F |
| 3,784,172 | 1/1974 | Sato et al. | 123/59 PC |
| 3,809,032 | 5/1974 | Morris | 123/52 M |
| 4,070,994 | 1/1978 | Garabedian | 123/198 F |
| 4,073,278 | 2/1978 | Glenn | 123/198 F |
| 4,109,634 | 8/1978 | Garabedian | 123/198 F |
| 4,264,535 | 4/1981 | Kikura | 261/23 A |
| 4,296,719 | 10/1981 | Takahashi et al. | 123/198 F |
| 4,319,553 | 3/1982 | Endo | 123/59 PC |
| 4,331,113 | 5/1982 | Tadokoro et al. | 123/198 F |

FOREIGN PATENT DOCUMENTS

| | | | |
|---|---|---|---|
| 2911555 | 9/1979 | Fed. Rep. of Germany | 123/198 F |
| 52-18342 | 4/1977 | Japan . | |
| 402679 | 3/1974 | U.S.S.R. | 123/198 F |

*Primary Examiner*—Parshotam S. Lall
*Assistant Examiner*—W. R. Wolfe
*Attorney, Agent, or Firm*—Fleit, Jacobson, Cohn & Price

[57] ABSTRACT

Intake system for a multiple cylinder internal combustion engine having primary and secondary passages leading to each cylinder and respectively provided with throttle valves. The primary passages for the respective cylinders are connected together through a first communicating passage of relatively large cross-sectional area and a second communicating passage of a relatively small cross-sectional area which is downstream of the first passage. One of the primary passages is provided with a shut-off valve which is located close to but downstream of the second communicating passage and adapted to be closed in idling operation or deceleration of the engine for directing the mixture totally toward the cylinder associated with the other primary passage. The primary and secondary passages leading to the same cylinder are connected together by a connecting passage downstream of the throttle valve. The connecting passage for the primary passage having the shut-off valve is located downstream of the shut-off valve so as not to weaken the function of the shut-off valve.

4 Claims, 3 Drawing Figures

INTAKE SYSTEM FOR MULTIPLE CYLINDER INTERNAL COMBUSTION ENGINE

This application is a continuation of application Ser. No. 289,696, filed Aug. 3, 1981, now abandoned, which is a continuation of application Ser. No. 022,310, filed Mar. 20, 1979, now abandoned.

The present invention relates to multiple-cylinder internal combustion engines and more particularly to multiple cylinder engines having intake systems comprised of primary and secondary intake passages communicating with respective cylinders.

In general, it has been recognized that, in an internal combustion engine, charge of combustible mixture is decreased under a deceleration or idling operation, which means that a throttle valve is closed, to such an extent that a stable combustion can no longer be maintained and misfire is often produced. As the result of such unstable combustion or misfire, there will be an undesirable increase in unburnt noxious constituents such as CO and HC in the exhaust gas.

In order to solve the above problem, it has been proposed for example by the U.S. Pat. No. 3,578,116 and Japanese Utility Model Publication No. Sho 52-18342 to provide means for closing intake passages to some of the cylinders to thereby direct the intake mixture totally to the remaining cylinders. Similar proposal has also been made by the U.S. Pat. No. 2,114,655.

Referring more specifically to the proposal by the Japanese Utility Model Publication No. Sho 52-18342, there is disclosed a two cylinder engine having intake passages communicating with respective cylinders and connected together through a communicating passage. A shut-off valve is provided in one of the intake passages downstream of the communicating passage so that the intake mixture through both of the intake passages is directly totally to one of the cylinders when the shut-off valve is in closed position. The communicating passage then functions to direct the mixture in said one intake passage to the other intake passage. In this arrangement, it has been required to locate the communicating passage close to the shut-off valve for the purpose of preventing fuel in liquid form from accumulating in the area of the shut-off valve.

On the other hand, in a multiple cylinder engine having intake passages independently leading to respective cylinders, it is also required to communicate the intake passage with each other so that pulsations of intake mixture flow in respective cylinders are moderated to thereby ensure continuous flow of fuel through fuel passages in the respective intake passages. When the aforementioned communicating passage is utilized for the purpose of moderating the intake mixture pulsations, it must be located close to the throttle valve because the communicating passage may otherwise cause an undesirable interference between the intake passages and produce a further problem of output loss.

It may therefore be desirable to provide the communicating passage close to but downstream of the throttle valve and to locate the shut-off valve downstream of and close to the communicating passage. The arrangement is however considered impractical because it produces a further problem. In practice, both the throttle valve and the shut-off valve are actuated through mechanical linkages and if these valves are located close to each other there will be an interference of such linkages.

In an engine having a so-called two-barrel type intake system wherein the intake passage for each cylinder is comprised of primary and secondary passages, there is a further problem in that it is difficult to ensure a balanced mixture or fuel distribution among the cylinders under an idling operation or deceleration of the engine. If either one of the throttle valves in the secondary passages fails to close the associated passage satisfactorily, or if the throttle valves in the secondary passages are not uniformly adjusted at the closed positions, there will be an unbalance of mixture or fuel distribution among the cylinders.

In order to eliminate the above problem, means may be provided for connecting the primary passage with the secondary passage in the same intake passage. However, such connecting means may possibly have an effect of cancelling the function of the shut-off valve unless careful consideration is made in determining the location of the connecting means with respect to the shut-off valve.

It is therefore an object of the present invention to provide an intake system for a multiple cylinder engine having intake passages leading to respective cylinders and provided with means for connecting the intake passages and for directing intake mixture from one of the intake passages to the other without producing any problem of interference between the passages.

Another object of the present invention is to provide an engine intake system including two-barrel type intake passages having means for ensuring a uniform gas distribution among cylinders.

A further object of the present invention is to provide a two-barrel type engine intake system which has connecting means between the primary and secondary passages for ensuring a uniform gas distribution among cylinders, said connecting means being so located that it does not have any adverse effect on the function of the shut-off valve.

According to the present invention, the above and other objects can be accomplished by a multiple-cylinder internal combustion engine comprising a plurality of cylinders, a plurality of intake passage means leading to the respective ones of the cylinders and each comprised of primary and secondary passages, throttle valve means provided in each of the primary and secondary passages, first communicating meand downstream of the throttle valve means in said primary passages for establishing communications between the primary passages for the respective cylinders, second communicating means downstream of the first communicating means for connecting together the primary passages, shut-off valve means provided in at least one of the primary passages close to and downstream of said second communicating means, said shut-off valve means being movable between closed and open positions and adapted to be closed under idling operation and deceleration of the engine to thereby interrupt supply of intake gas to the cylinder which is associated with the primary passage in which said shut-off valve means is provided. Preferably, the second communicating means has a cross-sectional area substantially smaller than that of the first communicating means in order to avoid any interference between the intake passage means. In order to provide a uniform mixture distribution among the cylinders, each primary passage may be connected with the secondary passage which is associated with the same cylinder as said primary passage. In the primary passage having the shut-off valve means, the passage for establishing the aforementioned connection should preferably be provided downstream of the shut-off valve means so that the connecting passage does not have any adverse effect on the function of the shut-off valve means.

The above and other objects and features of the present invention will become apparent from the following descriptions of a preferred embodiment taking reference to the accompanying drawings, in which.

Figure 1:
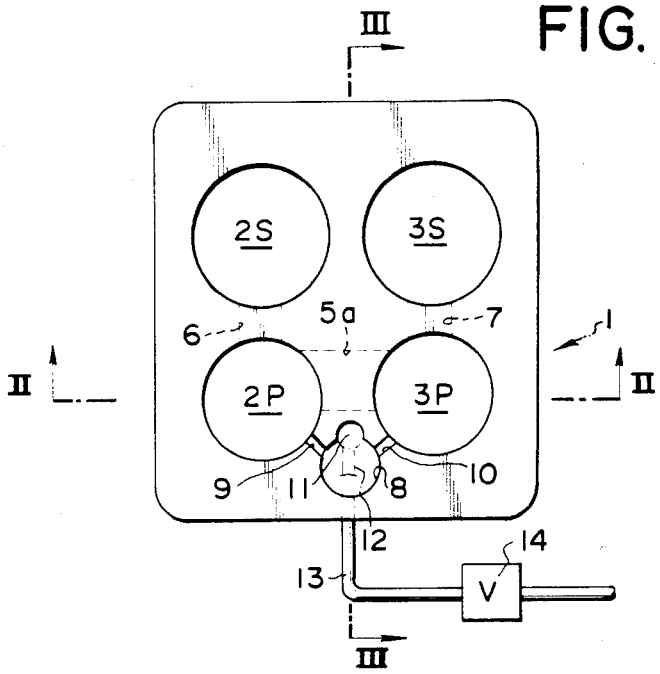
FIG. 1 is a cross-sectional view of the engine intake system embodying the features of the present invention.
Figure 2:
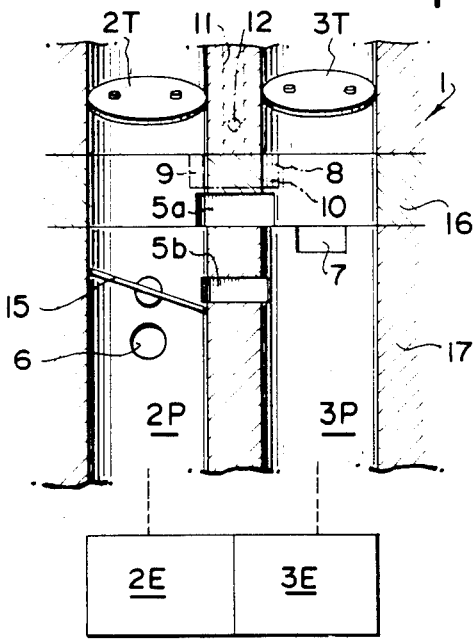
FIG. 2 is a sectional view taken substantially along the line II—II in FIG. 1.
Figure 3:
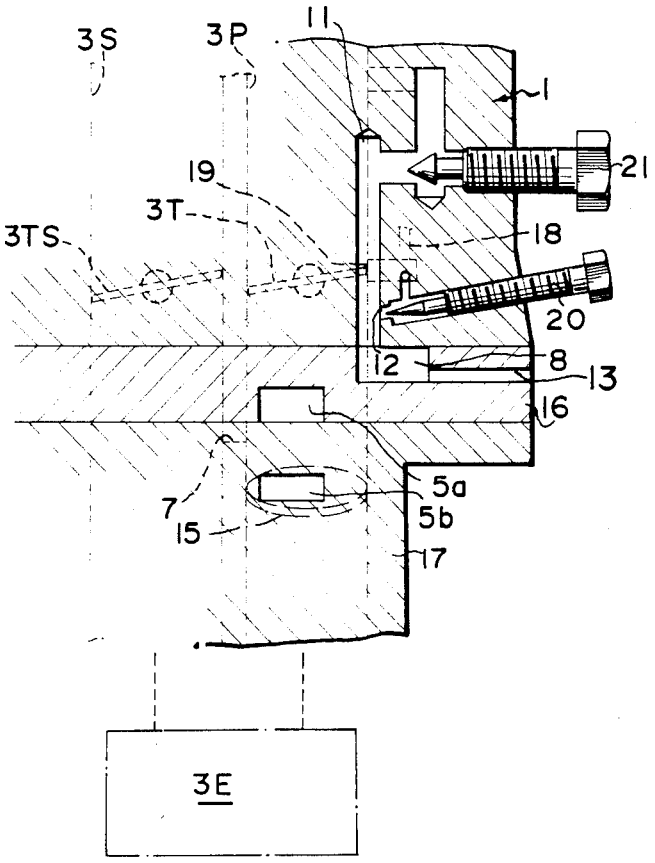
FIG. 3 is a sectional view taken substantially along the line III—III in FIG. 1.

Referring to the drawings, there is shown an intake system for a two-cylinder engine having cylinders 2E and 3E. The intake system includes a carburetor 1 which is connected through an insulator 16 with an intake manifold 17. Through the carburetor 1, the insulator 16 and the intake manifold 17, there are formed primary intake passages 2P and 3P and secondary intake passages 2S and 3S. The passages 2P and 2S provide a two-barrel type intake passage which is connected with the cylinder 2E, and the passages 2P and 2S are independently leading to the cylinder 2E. Similarly, the passages 3P and 3S provide a two-barrel type intake passage which is connected with the cylinder 3E. As shown in FIG. 3, the passages 3P and 3S are provided with throttle valves 3T and 3TS, respectively, which are actuated in a manner conventional in a two-barrel type carburetor. As shown in FIG. 2, the primary passage 2P is provided with a throttle valve 2T and, although not shown in the drawings, the secondary passage 2S for the cylinder 2E is provided with a throttle valve as in the passage 3S.

The intake system has a communication passage 5*a* which is formed in the insulator 16 downstream of the throttle valves 2T and 3T for connecting the primary passages 2P and 3P. In the intake manifold 17, there is also formed a second communication passage 5*b* which is located downstream of the passage 5*a*. In the primary passage 2P, there is provided a shut-off valve 15 which is located close to and downstream of the communication passage 5*b*. The communication passage 5*a* has a cross-sectional area which is large in relation to that of the passage 5*b*.

The primary and secondary passage 2P and 2S for the cylinder 2E are connected together by a passgage 6 and the primary and secondary passages 3P and 3S for the cylinder 3E are connected together by a passage 7. The passage 6 is formed in the intake manifold 17 at a position downstream of the shut-off valve 15. The passage 7 is formed by a groove or recess which is formed in the manifold 17 at the mating surface with the insulator 16. Thus, it will be noted that the primary and secondary passages for each cylinder are connected together at portions downstream of the throttle valves.

In the carburetor 1, there is formed an air bypass passage 11 which opens at one end to the primary passages 2P and 3P at positions upstream of the throttle valves 2T and 3T and at the other end with a mixing chamber 8 formed in the insulator 16. The mixing chamber 8 is of a circular cross-sectional configuration and connected respectively through passages 9 and 10 with the primary passages 2P and 3P. A slow fuel passage 18 formed in the carburetor 1 is opened on one hand to the primary passages through slow ports 19 and on the other hand to the air bypass passage 11 through an idle jet 12. In order to regulate the amount of fuel through the idle jet 12, there is provided an adjust screw 20. Another adjust screw 21 is further provided in the air bypass passage 11 for controlling the amount of bypass air. A blow-by gas recirculating passage 13 is provided to open to the mixing chamber 8 at a side opposite to the side where the air bypass passage 11 opens to the mixing chamber 8. In the passage 13, there is provided a ventilation valve 14 which may be of a conventional design. The mixing chamber 8 is provided in order to accomplish an intimate mixing of fuel from the idle jet 12 and air through the passage 11. In the illustrated arrangement, a better atomization of fuel can be accomplished by directing the blow-by gas opposite to the air flow from the passage 11. Further, the mixture produced in the mixing chamber 8 is uniformly distributed through the passages 9 and 10 to the primary passages 2P and 3P under the intake suction pressure prevailing in the primary passages. It should be noted, however, that the mixing chamber 8 may be omitted and the air bypass passage 11 may directly be opened to the primary passages 2P and 3P.

In the arrangement described above, the shut-off valve 15 may be interconnected with the throttle valve 2T in the primary intake passage 2P so that the valve 15 is closed in idling operation and deceleration of the engine. Alternatively, any suitable means may be provided to detect that the engine is in the idling operation or under deceleration and close the shut-off valve 15. When the shut-off valve 15 is thus closed, substantial part of the intake gas which may be mostly introduced from the mixing chamber 8 through the passage 9 to the primary intake passage 2P is passed through the passage 5*a* of larger cross-sectional area to the primary intake passage 3P. Any liquid fuel which may be deposited on the shut-off valve 15 or on the passage wall in the vicinity of the shut-off valve 15 is passed along the inclined surface of the shut-off valve 15 and through the passage 5*b* of smaller cross-sectional area to the primary passage 3P so that there is least possibility of liquid fuel accumulation around the shut-off valve 15. It has been found that a satisfactory result can be obtained with the ratio of the area of the second communicating passage 5*b* to that of the first passage 5*a* of 1/5 or 1/15, preferably 1/10. In this manner, the air-fuel mixture in the carburetor 1 is totally passed to the primary intake passage 3P. The charge of the mixture to the cylinder 3E is therefore increased and misfire can be prevented. Since the second communication passage 5*b* is of a relatively small cross-sectional area, it does not cause any critical interference between the primary passages 2P and 3P although it is located at a substantial distance toward the downstream side from the throttle valves 2T and 3T. The larger communication passage 5*a* can be located sufficiently close to the throttle valves 2T and 3T so that it is possible to avoid any interference between the primary passages 2P and 3P.

The communicating passages 6 and 7 are provided for the purpose of avoiding any unbalance of fuel or mixture distribution among the cylinders due to improper adjustments of the throttle valves in the secondary passages. According to the illustrated arrangement, the passage 6 provided in the primary passage 2P is located downstream of the shut-off valve 15. Since the passages 6 and 7 are aimed to equalize the intake suction pressures in the secondary passages 2S and 3S, they must communicate with each other through the passages 5*a* and 5*b* with a smallest possible distance. As another requirement, the communication passages 5*a* and 5*b* must be located at upstream portions of the intake passages.

In view of these facts, the communication passages 5*a* and 5*b*, the passages 6 and 7 and the shut-off valve 15 should be located in the insulator 16 or in the manifold 17 at portions close to the insulator. In the illustrated embodiment, the first communication passage 5*a* is provided in the insulator 16 and the second communication passage 5*b*, the passages 6 and 7 and the shut-off valve 15 are provided in the intake manifold 17. It should be noted, however, that they may totally be provided in the insulator 16 where the insulator 16 has an adequate thickness. According to the illustrated arrangement, the passage 6 is located downstream of the shut-off valve 15 so that the communication between the passages 6 and 7 is interrupted when the valve 15 is closed. It is therefore possible to prevent combustible mixture from being admitted to the cylinder 2E through the passage 6 and the secondary intake passage 2S.

Under a light load operation wherein the shut-off valve 15 is opened, the secondary intake passage 2S for the cylinder 2E is connected with the other secondary intake passage 3S through the passage 6, the primary intake passage 2P, the first and second communication passages 5*a* and 5*b*, the other primary passage 3P and the passage 7. The communication between the secondary intake passages 2S and 3S are effective to compensate for any unbalanced between the passages 2S and 3S due to unbalanced adjustments of the secondary throttle valves. Thus, the primary intake passages 2P and 3P are subjected to substantially equal intake suction pressure so that the fuel or air-fuel mixture and the blow-by gas are uniformly distributed between the primary intake passages 2P and 3P.

Under a high load operation, both of the primary and secondary throttle valves are opened so that the primary and secondary intake passages function without any influence from the passages 5*a*, 5*b*, 6 and 7.

The invention has thus been shown and described with reference to a specific embodiment, however, it should be noted that the invention is in no way limited to the details of the illustrated arrangements but changes and modifications may be made without departing from the scope of the appended claims.

We claim:

1. A multiple-cylinder internal combustion engine comprising at least first and second cylinder means; first and second passage means which are separated from each other and communicate, respectively, with the first and second cylinder means; throttle valve means provided in each of the first and second passage means; first and second light load fuel passage means branched from common fuel passage means and communicating through opening means respectively to said first and second passage means downstream of said throttle valve means; first communicating means immediately downstream of the opening means; means through which said first and second light load fuel passage means communicate with the first and second passage means for establishing communication between the first and second passage means to thereby moderate pulsations of intake gas flow; shut-off valve means provided in the first passage means downstream of said first communicating means, said shut-off valve means being movable between closed and open positions and closed under at least one of idling operation and deceleration of the engine to thereby interrupt the supply of intake gas flow to the first cylinder means which is associated with the first passage means in which said shut-off valve means is provided and to lead the intake gas in the first passage means to the second passage means through the first communicating means, said shut-off valve means being of a butterfly valve type which is inclined in the closed position, relative to said first passage means, to have an upstream edge portion and a downstream edge portion; second communicating means provided between the first communicating means and said shut-off valve means and located in the vicinity of the downstream edge portion of the shut-off valve means in the closed position for providing communication between the first and second passage means to direct liquid fuel that is collected thereon toward said second communicating means and thereby prevent accumulation of fuel at the shut-off valve means, said second communicating means having a cross-sectional area smaller than that of the first communicating means.

2. An engine in accordance with claim 1 in which each of the intake passage means is comprised of a primary passage and a secondary passage and the primary passage and secondary passage of one intake passage means are independently leading to one cylinder which is associated with said one intake passage means, and said primary passage and said secondary passage are connected through connecting passage means.

3. An engine in accordance with claim 1, in which each of the intake passage means is comprised of a primary passage and a secondary passage and in which said shut-off valve means is provided in at least one of the primary passages and the primary passage having the shut-off valve means is provided with connecting passage means which is located downstream of the shut-off valve means and connecting the primary passage with the secondary passage in the same intake passage means.

4. An engine in accordance with claim 1 in which the cross-sectional area of the second communicating passage means is 1/5 to 1/15 of that of the first communicating passage means.

* * * * *